US011020650B2

(12) United States Patent
Fellin et al.

(10) Patent No.: US 11,020,650 B2
(45) Date of Patent: Jun. 1, 2021

(54) CROSS-COUNTRY OR SKI TOURING BINDING

(71) Applicant: FISCHER SPORTS GMBH, Ried/Innkreis (AT)

(72) Inventors: Nicolas Fellin, Ried/Innkreis (AT); Hannes Kogler, Ried/Innkreis (AT)

(73) Assignee: FISCHER SPORTS GMBH, Ried/Innkreis (AT)

( * ) Notice: Subject to any disclaimer, the term of this patent is extended or adjusted under 35 U.S.C. 154(b) by 0 days.

(21) Appl. No.: 16/471,418

(22) PCT Filed: Dec. 19, 2017

(86) PCT No.: PCT/AT2017/060335
§ 371 (c)(1),
(2) Date: Jun. 19, 2019

(87) PCT Pub. No.: WO2018/112489
PCT Pub. Date: Jun. 28, 2018

(65) Prior Publication Data

US 2019/0381388 A1 Dec. 19, 2019

(30) Foreign Application Priority Data

Dec. 19, 2016 (AT) ..... A 51154/2016

(51) Int. Cl.
*A63C 9/00* (2012.01)
*A63C 9/08* (2012.01)
(Continued)

(52) U.S. Cl.
CPC ..... *A63C 9/0807* (2013.01); *A63C 9/20* (2013.01); *A43B 5/0411* (2013.01); *A63C 9/005* (2013.01); *A63C 9/086* (2013.01); *A63C 2201/06* (2013.01)

(58) Field of Classification Search
CPC ..... A63C 9/20; A63C 9/005; A63C 9/081; A63C 9/003; A63C 9/086
See application file for complete search history.

(56) References Cited

U.S. PATENT DOCUMENTS 6,957,827 B2 * 10/2005 Kogler ..... A63C 9/20 280/613
7,097,194 B2 * 8/2006 Kogler ..... A63C 9/20 280/607
(Continued)

FOREIGN PATENT DOCUMENTS

DE 9422308 U1 12/1999
EP 1559456 A1 8/2005
(Continued)

OTHER PUBLICATIONS

ISA European Patent Office, International Search Report Issued in Application No. PCT/AT2017/060335, dated Apr. 9, 2018, WIPO, 6 pages.

*Primary Examiner* — Hau V Phan
(74) *Attorney, Agent, or Firm* — McCoy Russell LLP

(57) ABSTRACT

The invention relates to a cross-country or ski touring binding for connecting a boot to a ski in an articulated manner, comprising a binding base body with a standing surface for a sole of the boot and a ski contact surface for at least indirect contact with the ski. The binding has a holding device comprising a receiving element which allows the boot to and a holding element for holding the boot on the receiving element. The holding element moves between a closed position holding the boot on the receiving element and an open position releasing the boot. The binding also has an actuating element with a rotating handle for switching the holding element from the closed to the open position,
(Continued)

comprising a substantially disk-shaped, eccentrically mounted force-transmission element received in a recess of the holding element.

15 Claims, 10 Drawing Sheets

(51) Int. Cl.

| | |
|---|---|
| ***A63C 9/20*** | (2012.01) |
| *A43B 5/04* | (2006.01) |
| *A63C 9/086* | (2012.01) |

(56) References Cited

U.S. PATENT DOCUMENTS

| | | | | |
|---|---|---|---|---|
| 7,111,865 | B2 * | 9/2006 | Girard | A43B 5/0413 280/623 |
| 7,264,263 | B2 * | 9/2007 | Riedel | A63C 9/20 280/614 |
| 7,922,188 | B2 * | 4/2011 | Kogler | A63C 9/20 280/615 |
| 8,973,924 | B2 | 3/2015 | Rullier et al. | |
| 9,050,521 | B2 * | 6/2015 | Girard | A63C 9/20 |
| 9,126,095 | B2 * | 9/2015 | Wollo | A63C 9/003 |
| 2008/0231019 | A1 * | 9/2008 | Villani | A63C 17/045 280/604 |
| 2008/0309053 | A1 * | 12/2008 | Mangold | A63C 9/081 280/614 |
| 2012/0104707 | A1 * | 5/2012 | Merino | A63C 9/0805 280/11.33 |
| 2013/0207356 | A1 * | 8/2013 | Barthel | A63C 9/086 280/11.33 |
| 2014/0300068 | A1 * | 10/2014 | Rullier | A63C 9/005 280/11.33 |
| 2016/0220889 | A1 * | 8/2016 | Holm | A63C 9/20 |

FOREIGN PATENT DOCUMENTS

| | | | |
|---|---|---|---|
| EP | 1721641 | A1 | 11/2006 |
| EP | 2786789 | A1 | 10/2014 |
| WO | 2012036562 | A1 | 3/2012 |

* cited by examiner

CROSS-COUNTRY OR SKI TOURING BINDING

CROSS-REFERENCE TO RELATED APPLICATIONS

The present application is a U.S. National Phase of International Patent Application Serial No. PCT/AT2017/060335 entitled "CROSS-COUNTRY OR SKI TOURING BINDING," filed on Dec. 19, 2017. International Patent Application Serial No. PCT/AT2017/060335 claims priority to Austrian Patent Application No. A 51154/2016, filed on Dec. 19, 2016. The entire contents of each of the above-cited applications are hereby incorporated by reference for all purposes.

TECHNICAL FIELD

The invention relates to a cross-country or ski touring binding for connecting a boot to a ski in an articulated manner, comprising a binding base body which comprises a standing surface for a sole of the boot and a ski contact surface for at least indirect contact with the ski, a holding device, which comprises a receptacle for the pivotable arrangement of the boot about a pivot axis extending in the transverse direction of the binding base body, and a holding element for holding the boot on the receptacle, wherein the holding element is mounted on the binding base body to be movable between a closed position holding the boot on the receptacle and an open position releasing the boot, an actuating element which comprises a rotating handle for transferring the holding element from the closed into the open position, whose axis of rotation extends essentially perpendicular to the standing surface of the binding base body.

BACKGROUND

Such a cross-country binding is known from DE 94 22 308 U1. This cross-country binding comprises a holding hook which is connectable to a hinge axis at the front end of the sole of a cross-country boot. A rotary disk is provided on the cross-country binding to release the connection to the cross-country boot. By rotating the rotary disk, the holding hook is displaced from a closed into a release position. The holding hook is eccentrically connected to the rotary disk for this purpose. The rotational movement of the rotary disk is initially transferred to a connecting rod which is connected via an articulated connection to a U-shaped bracket, which is hooked to the hinge axis of the cross-country boot.

Thus, a comparably complicated force transmission mechanism is provided in the prior art in order to establish and release the connection between the hinge axis of the cross-country boot and the cross-country binding. The high weight of the known force transmission mechanism is particularly disadvantageous. In addition, the combined pivot and thrust movement of the connecting rod between the rotary disk and the U-shaped holding bracket may impair the function. The transition of the cross-country binding between the closed and the release position may then, in particular, become more difficult or even be prevented in the prior art, if ice formations impair the lateral movement required for the combined pivot and thrust movement of the connecting rod.

A cross-country binding is known from WO 2012/036562 A1, which comprises a binding base body comprising a standing surface for a sole of the cross-country boot and a holding device for pivotable arrangement of the cross-country boot about a pivot axis extending in the transverse direction of the binding base body. A push-button is provided as the actuating element to transfer the holding element from a closed into an open position. The push-button is thereby pivoted about an axis extending essentially in the direction of the standing surface. To transfer the force between the push-button and the holding element, the push-button comprises a projection which is accommodated in an opening of the holding element so that the holding element is pushed forward behind the axis of rotation upon pressing the push-button down.

Another type of alpine binding is known from EP 2 786 789 A1, in which an eccentric is provided in order to pivot the contact plate of an alpine binding and thus to change the height of the standing surface.

The object of the invention consists in alleviating or avoiding the disadvantages of the prior art. This goal of the invention is therefore in particular to improve the known embodiments of cross-country or ski touring bindings such that a more reliable and more effective force transmission is achieved from the rotatable actuating element to the holding device for the boot.

This problem is solved by a cross-country or ski touring binding for connecting a boot to a ski in an articulated manner, comprising a binding base body which comprises a standing surface for a sole of the boot and a ski contact surface for at least indirect contact on the ski, a holding device, which comprises a receptacle for the pivotable arrangement of the boot about a pivot axis extending in the transverse direction of the binding base body, and a holding element for holding the boot on the receptacle, wherein the holding element is mounted on the binding base body to be displaceable between a closed position holding the boot on the receptacle and an open position releasing the boot, an actuating element which comprises a rotating handle for transferring the holding element from the closed into the open position, whose axis of rotation extends essentially perpendicular to the standing surface of the binding base body, characterized in that the actuating element comprises an essentially disk-shaped, eccentrically-mounted force transmission element, which is accommodated in a recess of the holding element for converting the rotational movement of the rotating handle into the displacement of the holding element such that, by means of a rotational movement of the rotating handle, the holding element is transferable from the closed into the open position and vice versa. Preferred embodiments are indicated in the dependent claims.

According to the invention, the actuating element comprises a substantially disk-shaped, eccentrically-mounted force transmission element which is accommodated in a recess of the holding element in order to convert the rotational movement of the rotating handle into a displacement of the holding element so that the holding element is transferrable from the closed into the open position and vice-versa by means of a rotational movement of the rotating handle.

Accordingly, a displaceable, i.e., translationally movable holding element is provided in the invention, which may engage around a hinge axis on the cross-country or ski touring boot in the closed position such that the boot is held pivotably on the binding. To release the connection between boot and binding, the actuating element is provided, which may be switched by the skier between the closed and open position. The actuating element comprises a rotating handle, whose axis of rotation preferably extends essentially perpendicular to the standing surface of the binding base body.

To convert the rotational movement of the rotating handle into the displacement of the holding element, the actuating element additionally comprises an essentially disk-shaped force transmission element, which is connected rotationally fixed to the rotating handle. Thus, the essentially disk-shaped force transmission element may participate in the rotational movement of the rotating handle. To transfer the force to the holding element, the force transmission element is mounted eccentrically with respect to the axis of rotation of the rotating handle. In the following, the force transmission element will therefore also be designated as the eccentric disk as a short form. The eccentric disk is accommodated in a recess of the holding element in such a way that the holding element is displaced translationally, preferably essentially in the longitudinal direction of the binding base body, during a rotation of the actuating element. For this purpose, the recess is designed as a motion link, wherein the recess is preferably elongated, in particular is essentially oval in a top view. By rotating the rotating handle in the one direction, the engagement may be established between the holding element and the hinge axis of the boot. Conversely, the engagement between the holding element and the hinge axis of the boot may be released by rotating the rotating handle in the other direction. The embodiment according to the invention includes in particular the advantage that the holding element is exclusively linearly displaceable, by which means the guiding of the holding element on the binding base body may be facilitated. The more complicated kinematics of the prior art according to DE 94 22 308 U1 may likewise be avoided, like the necessity of an articulated linking of the connecting rod to the rear end of the hook element. Furthermore, the force transmission element according to the invention is distinguished by high reliability over long periods of use. Furthermore, the weight may be reduced.

With regard to a stable, simple, and part-saving embodiment, it is favorable if the recess is designed in a force transmission section of the holding element, which is connected via a connecting section, preferably as one piece, to a holding section of the holding element comprising a hook-shaped projection. Accordingly, the force transmission section, connecting section, and holding section of the holding element are preferably formed as one piece.

To guide the hook-shaped projections in the movement between the closed and open position, and to at least partially cover them, it is advantageous if the hook-shaped projections are displaceably accommodated in slot-shaped recesses in the binding base body.

To create a rigid connection, i.e. a connection that is essentially unmoving in the longitudinal direction in the closed position between the holding element and the force transmission element, it is favorable if the recess accommodating the force transmission element is closed in the peripheral direction. Thus, a direct force transmission between the holding element and the force transmission element is facilitated. In this embodiment, the hinge axis of the boot may only be arranged on the receptacle of the holding device after rotation of the rotating handle into the open position.

For indirect force transmission between the force transmission element and the holding element, it is provided in another preferred embodiment that the recess accommodating the force transmission element comprises an open section on a side directed toward the receptacle. An intermediate element may be provided at the open section of the recess to receive the movement of the force transmission element and to transfer it to the holding element.

In this embodiment, it is favorable if the holding element is mounted to be displaceable against the force of the spring in the closed position. Thus, the boot is connected to the binding in the closed position. The holding element in this embodiment may be pressed for a short period of time into the open or release position by placing the hinge axis of the boot such that the hinge axis may be arranged in the receptacle of the holding device before the holding element snaps back into the closed position due to the effect of the spring.

To facilitate the spring-mounted arrangement of the holding element in the closed position, it is favorable if the spring is arranged between the holding element and a spring abutment, wherein a front end section of the spring abutment is arranged at the open section of the recess and is connected to an operating section of the essentially disk-shaped force transmission element in the closed position.

According to one particularly preferred embodiment, the rotating handle of the actuating element comprises at least one latching element which, in the closed position, engages in a latched position with a latching element designed on the binding base body.

This embodiment may basically also be used with a force transmission element which is different from the one previously described.

Consequently, the present disclosure also relates to a cross-country or ski touring binding for connecting a boot to a ski in an articulated manner, comprising a binding base body which comprises a standing surface for a sole of the boot and a ski contact surface for at least indirect contact on the ski, a holding device, which comprises a receptacle for the pivotable arrangement of the boot about a pivot axis extending in the transverse direction of the binding base body, and a holding element for holding the boot on the receptacle, wherein the holding element is mounted on the binding base body to be displaceable between a closed position holding the boot on the receptacle and an open position releasing the boot, an actuating element, which comprises a rotating handle for transferring the holding element from the closed into the open position, wherein the actuating element comprises at least one latching element, which, in the closed position, engages in a latched position with a latching element designed on the binding base body.

For secure latching of the actuating element in the closed position, the rotating handle of the actuating element preferably comprises at least two latching elements arranged at a distance from each other, wherein the one latching element is preferably provided in a front end section of the rotating handle facing away from the receptacle in the closed position and the other latching element is provided on a rear end section of the rotating handle facing the receptacle, and corresponding latching elements are designed on the binding base body. Correspondingly, in this embodiment, at least two latching connections are provided, which counteract a rotation of the rotating handle from the closed position in the direction of the open position. By this means, malfunctions, in particular an unintentional release of the connection between the boot and binding, may be reduced. The latching elements are arranged on different longitudinal positions of the rotation handle, preferably at its opposite end sections, by which means a particularly secure connection is created.

The latching of the rotating handle in the closed position is particularly stable if a first connection plane extends essentially along the standing surface between first corresponding latching elements and/or a second connection plane extends essentially perpendicular to the standing surface between second corresponding latching elements.

Accordingly, the one latching connection is effective in the essentially horizontal first connection plane; the other latching connection is effective in the essentially vertical second connection plane. Thus, the rotating handle may be reliably held in the closed position, for example, if the rotating handle is exposed to different shock or impact stresses during use.

For the purpose of this disclosure, the positional and directional indications, like "horizontal", "vertical", "upper", "under", "front", "rear", etc. relate to the intended usage state of the binding on the ski in this horizontal standard position, wherein "front" means closer to the ski tips and "rear" means closer to the ski ends.

To facilitate a reliable latching on the one hand and to facilitate convenient operation by the skier on the other, a latching groove and a spring-mounted latching lug are provided preferably in each case as corresponding latching elements, wherein the latching groove is preferably provided on the actuating element and the latching lug on the binding base body.

To achieve a simple, yet effective, latching connection, the latching lug is preferably designed on an essentially wave shaped latching element, which comprises a release position on its longitudinal sides with respect to the remaining binding base body or remaining actuating element.

To hold the hinge axis of the boot, a bearing element is preferably provided, which comprises bearing blocks within each case a depression for the pivotable arrangement of the boot, wherein the depressions of the bearing blocks are arranged adjacent to the receptacle of the holding device in the closed position.

For manufacturing reasons, the binding base body and the bearing blocks are preferably designed as one piece, wherein the depressions of the bearing blocks are formed by material cut-outs of the binding base body.

BRIEF DESCRIPTION OF THE FIGURES

The invention is subsequently explained in greater detail by way of preferred exemplary embodiments; however, it is not to be limited to the same.

DETAILED DESCRIPTION

Figure 1:
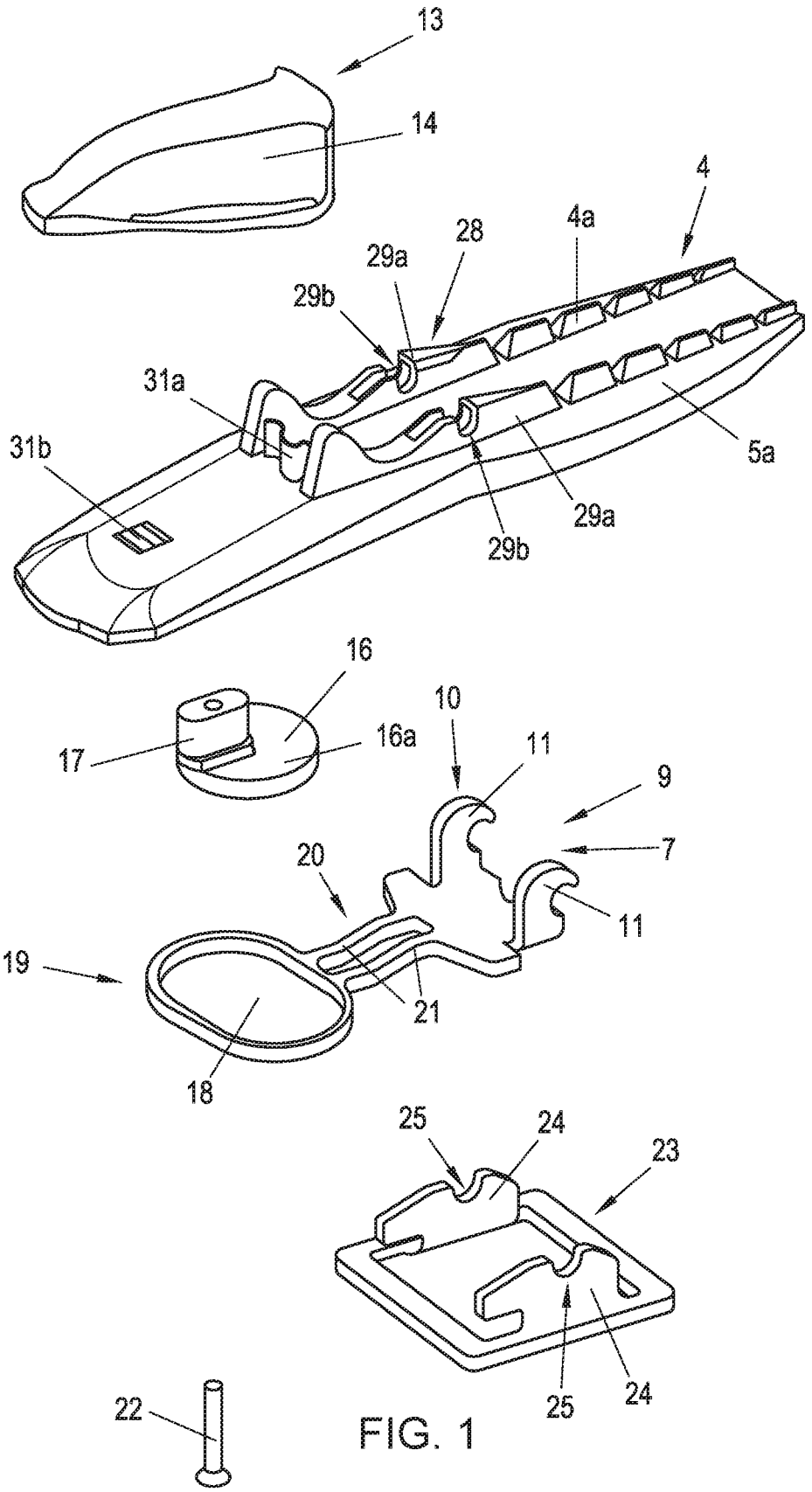
FIG. 1 schematically shows an exploded view of a cross-country binding according to the invention, in which the rotational movement of a rotating handle is transferred via an eccentric disk to hook-shaped extensions on a holding element, which, in a closed position, holds a hinge axis of the cross-country boot (visible in FIGS. 6, 7) on the cross-country binding.
Figure 2:
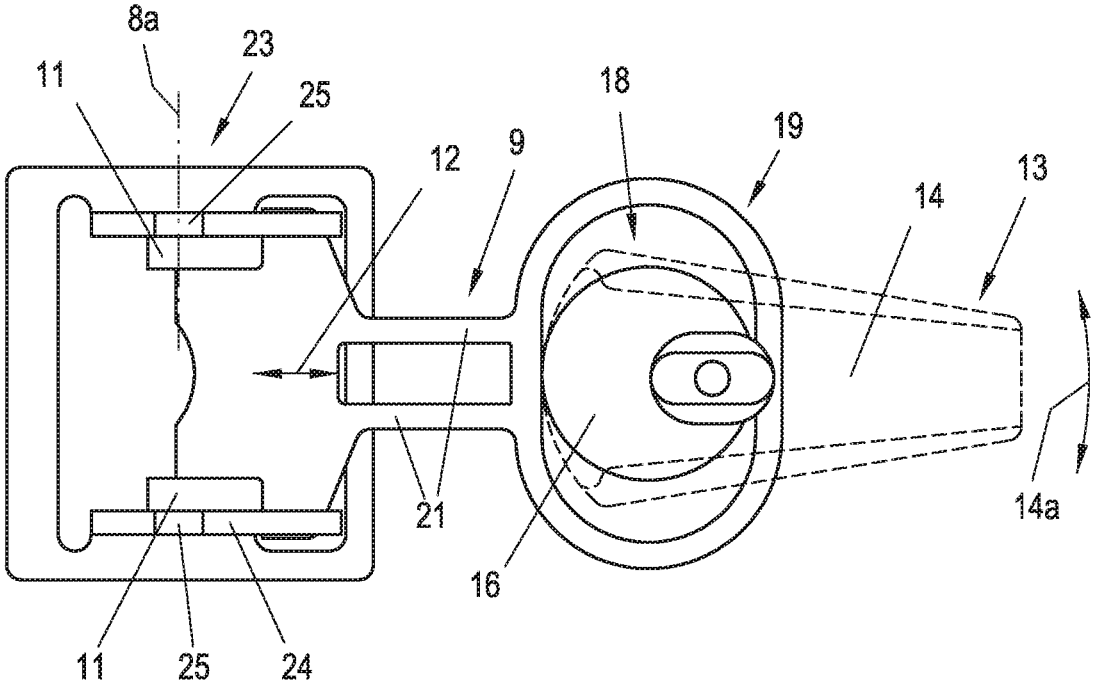
FIG. 2 schematically shows a top view of the cross-country binding according to FIG. 1 (without the binding base body) in the closed position.
Figure 3:
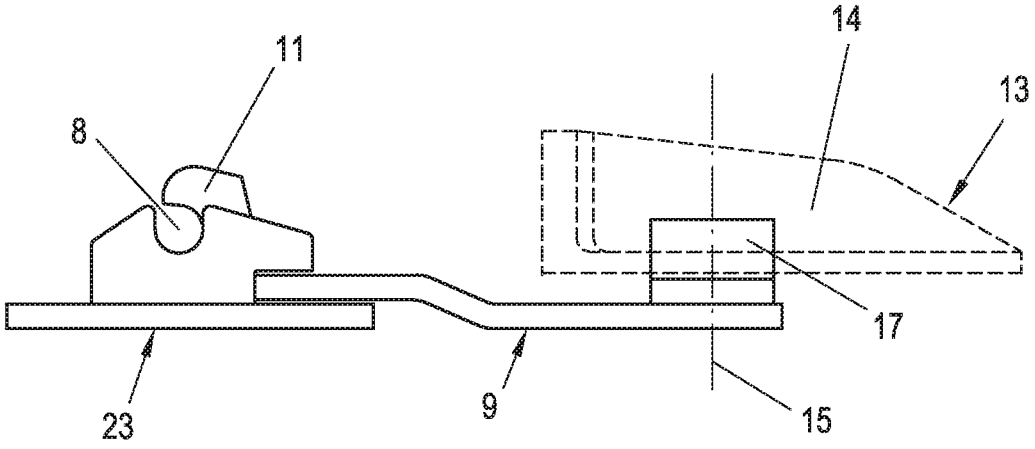
FIG. 3 schematically shows a side view of the cross-country binding according to FIG. 2.
Figure 4:
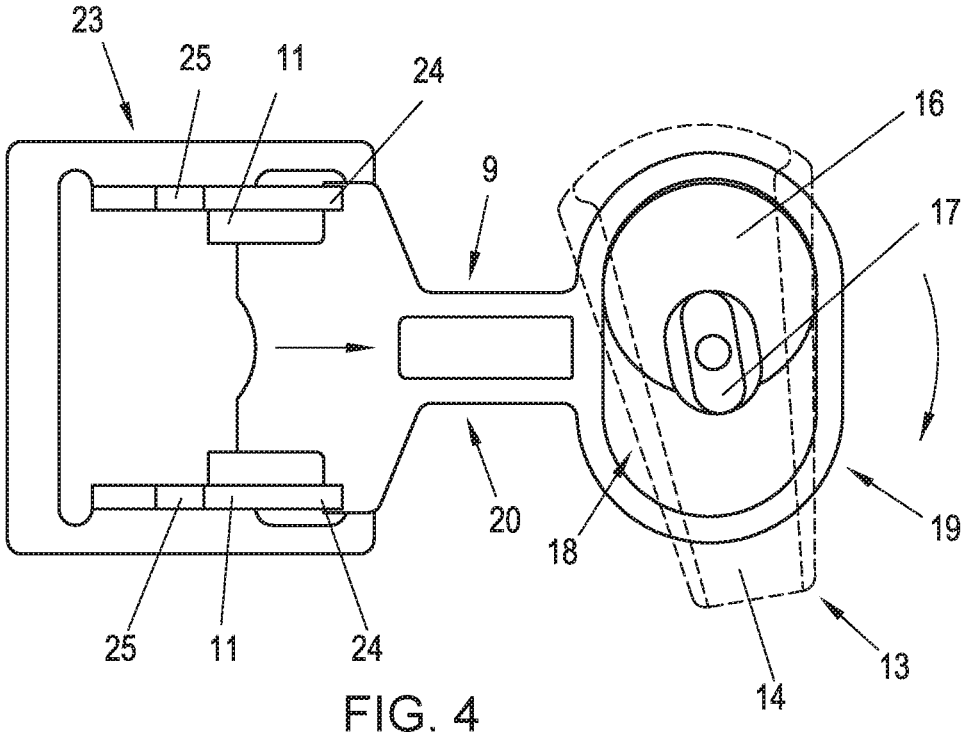
FIG. 4 schematically shows a top view of the cross-country binding according to FIGS. 2, 3 in the rotated state of the rotating handle to release the hinge axis of the cross-country boot by displacing the holding element.
Figure 5:
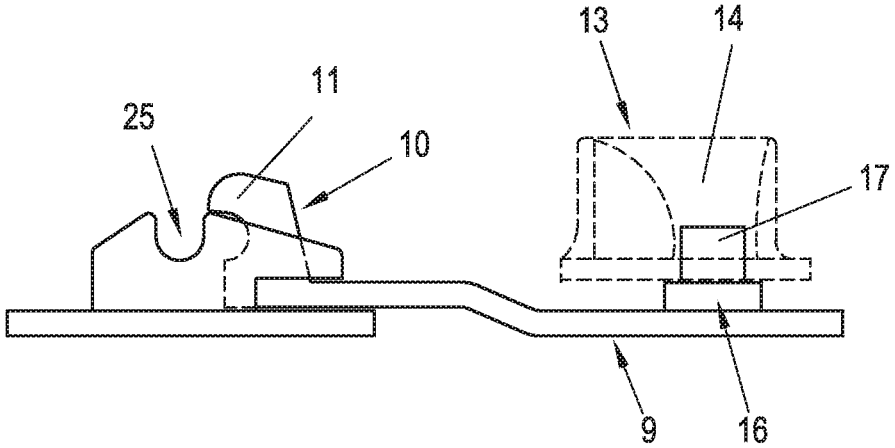
FIG. 5 schematically shows a side view of the cross-country binding in the open position according to FIG. 4.
Figure 6:
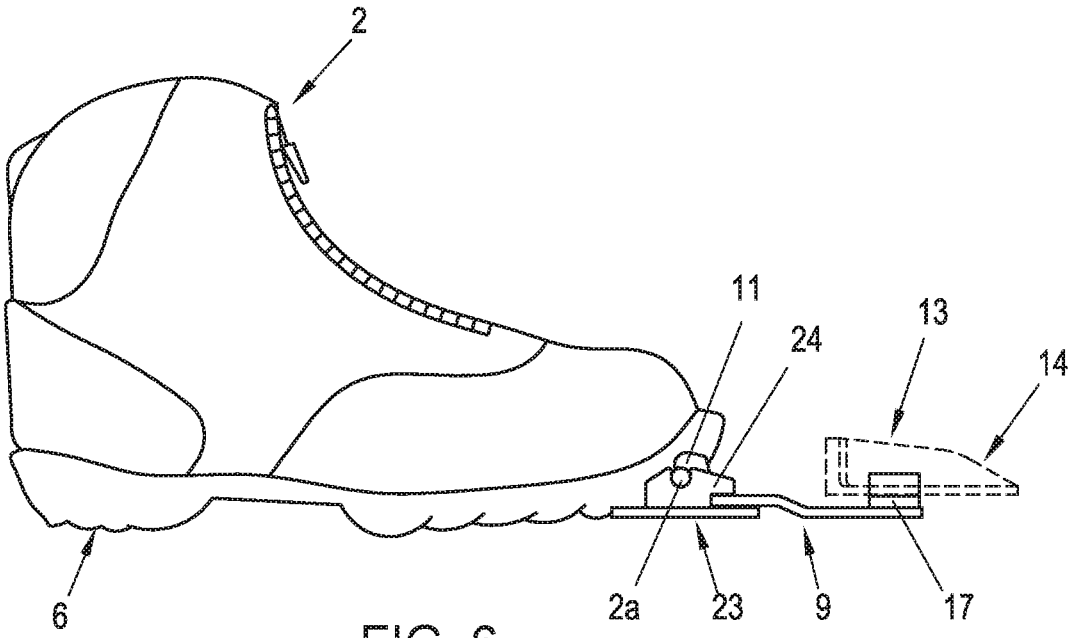
FIG. 6 schematically shows a cross-country boot in a fixed position to be pivotable on the cross-country binding according to FIGS. 1 to 5, wherein the hinge axis is held by the hook-shaped projections.
Figure 7:
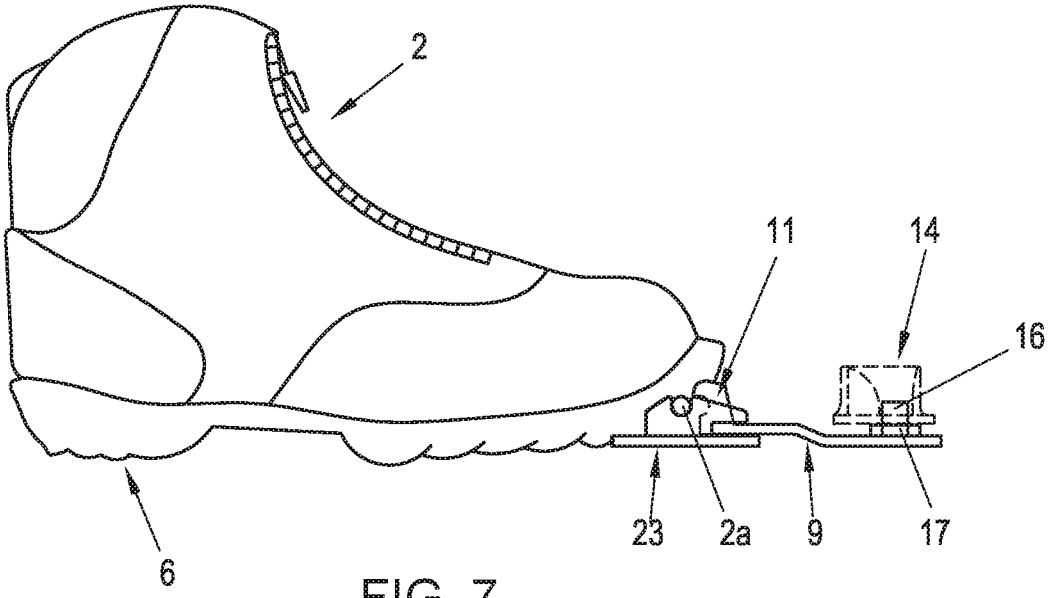
FIG. 7 schematically shows the cross-country boot according to FIG. 6, wherein the hinge axis was freed from the hook-shaped projections by rotating the rotating handle.

A cross-country binding 1 for connecting a cross-country boot 2 (see FIGS. 6, 7) to a cross-country ski 3 in an articulated manner is shown in FIGS. 1 to 7. Cross-country kits of this type have been known for a long time in the prior art, so that in the following only the features essential for the invention shall be described. A cross-country binding 1 is shown in the drawing; however, a corresponding embodiment might also be used for a ski touring binding, which may be converted between a climbing position for a pivotable arrangement of a ski touring boot on the ski touring binding and a downhill position for fixing the heel area of the ski touring boot to the ski touring binding.

Binding 1 comprises a binding base body 4 formed from an essentially unyielding (hard plastic) material, which comprises guide rails 4*a* in a central area. On the upper side, binding base body 4 comprises a standing surface 5*a* for placing a sole 6 of the (cross-country) boot 2 (see FIGS. 6, 7). On the underside, binding base body 4 comprises an essentially flat ski contact surface 5*b*, which is mounted in the embodiment shown directly on a (cross-country) ski 3. However, additional plate shaped mounting elements (not shown) may be provided between binding base body 4 and ski 3. In this case, ski contact surface 5*a* is connected indirectly to ski 3.

In addition, binding 1 comprises a holding device 7 for detachable connection to boot 2. Holding device 7 comprises a receptacle 8 for pivotable arrangement of a hinge pin 2*a* of boot 2 about a pivot axis 8*a* (see FIG. 2), which extends in a transverse direction of binding base body 4 (i.e., in the mounted state in a transverse direction of cross-country ski 3). Holding device 7 additionally comprises a holding element 9 for pivotable holding of boot 2 on receptacle 8. For this purpose, holding element 9 comprises a holding section 10 with hook-shaped projections 11. Holding element 9 is mounted on binding base body 4 to be displaceable in longitudinal direction 12 of binding base body 4 (and thus in the longitudinal direction of ski 3) between a closed position, holding hinge axis 2*a* of boot 2 pivotably on receptacle 8 (see FIGS. 2, 3), and an open position releasing hinge axis 2*a* of boot 2 (see FIGS. 4, 5). To release hinge axis 2*a* of boot 2 from receptacle 8, binding 1 comprises an actuating element 13 on the upper side of binding base body 4. Actuating element 13 comprises a rotating handle 14, which is mounted on binding base body 4 to be rotatable about an axis of rotation 15 (see FIG. 3) extending essentially perpendicular to ski contact surface 5*b* (i.e., essentially in the vertical direction). Correspondingly, rotating handle 14 may be rotated in an essentially horizontal plane in both directions from the non-rotated position, shown in FIGS. 2, 3, into the rotated position, shown in FIGS. 4, 5 (see double arrow 14*a* in FIG. 2). The rotational movement of rotating handle 14 from the non-rotated position, in which rotating handle 14 is preferably oriented essentially in longitudinal direction 12 of binding base body 4, into the rotated position, in which rotating handle 14 is preferably oriented essentially in the transverse direction of binding base body 4, is converted into the displacement of holding element 9 in longitudinal direction 12 from the closed into the open position.

To transfer the force to holding element 9, actuating element 13 additionally comprises an essentially disk-shaped, eccentrically mounted force transmission element 16, subsequently designed as eccentric disk 16 as a shorted form. Eccentric disk 16 is arranged in a positive locking way on rotating handle 14 by means of a coupling projection 17 so that eccentric disk 16 is connected rotationally fixed to rotating handle 14. To convert the rotating movement of actuating element 13 into the displacement of holding element 9, eccentric disk 16 is accommodated in an elongated or oval recess 18 of holding element 9. By rotating the rotating handle, a bulbous operating section 16*a* of eccentric disk 16 is pressed against the corresponding abutment surface of holding element 9 in such a way that holding element 9 is displaced from the closed position into the open position and vice versa. In the embodiment from FIGS. 1 to 9, recess 18 accommodating force transmission element 16 is completely closed on the peripheral side.

In the embodiment shown, recess 18 is provided on a force transmission section 19 of holding element 9, which is connected via a connecting section 20 with two connecting bars 21 to holding section 10 of holding element 9, on which projecting hook-shaped projections 11 are formed for engaging around hinge axis 2*a* of boot 2. Holding section 10, connecting section 20, and force transmission section 19 of holding element 9 are preferably formed as one piece. Force transmission element 16 and rotating handle 14 are connected to each other via a connecting element 22, in this case a screw.

In addition, binding 1 comprises a bearing part 23, which comprises upwardly directed flanks 24 with indentations 25 for accommodating hinge axis 2*a*. Flanks 24 of bearing part 23 are accommodated in openings 26 of binding base body 4 (see, in particular, FIG. 9). Binding base body 4 comprises slot shaped recesses 27 which are adjacent to openings 26 and in which hook-shaped projections 11 (not visible in FIG. 9) of holding element 9 are displaceably accommodated. In addition, a bearing element 28 is designed as one part on binding base body 4 and comprises bearing blocks 29*a* with in each case a depression 29*b* for pivotable arrangement of hinge axis 2*a* of boot 2. Depressions 29*b* of bearing blocks 29*a* are arranged flush with indentations 25 of bearing part 23 in the mounted state, when viewed in the direction of hinge axis 2*a*. Binding base body 4 is preferably formed from a hard plastic material, whereas in contrast, holding element 9 and bearing part 23 are preferably manufactured from metal.

Figure 8:
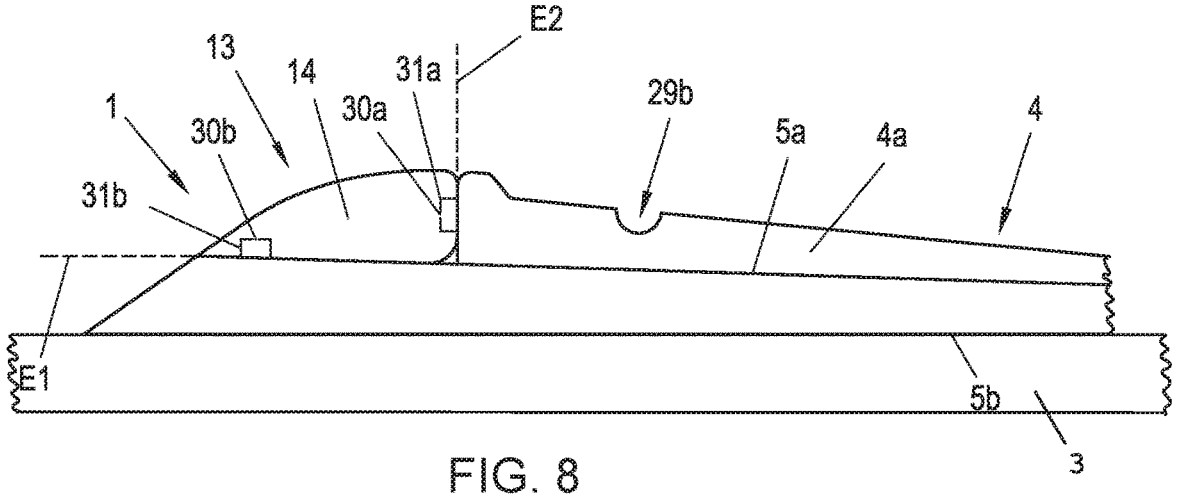
FIG. 8 schematically shows parts of a cross-country binding according to the invention in which the rotating handle, in the non-rotated state corresponding to the closed position of the holding element, is fixed on the binding base body by a latching connection on the front end and on the rear end respectively of the rotating handle.
Figure 9:
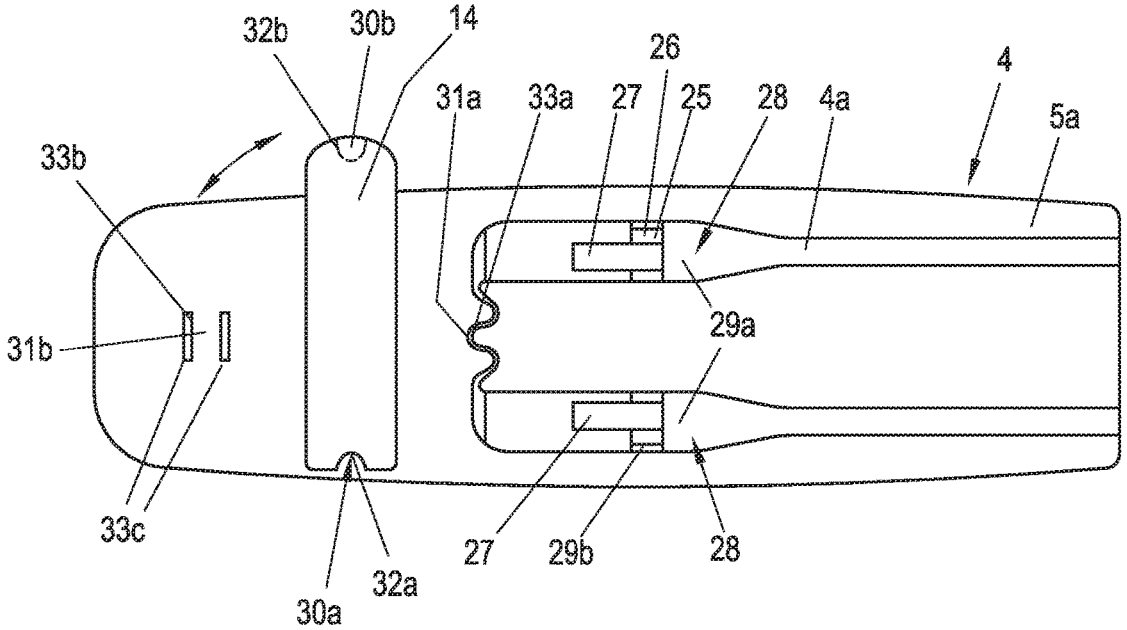
FIG. 9 shows the parts of the cross-country binding according to FIG. 8 in the rotated position of the rotating handle, wherein the latching engagement has been released between the rotating handle and the binding base body.
Figure 10:
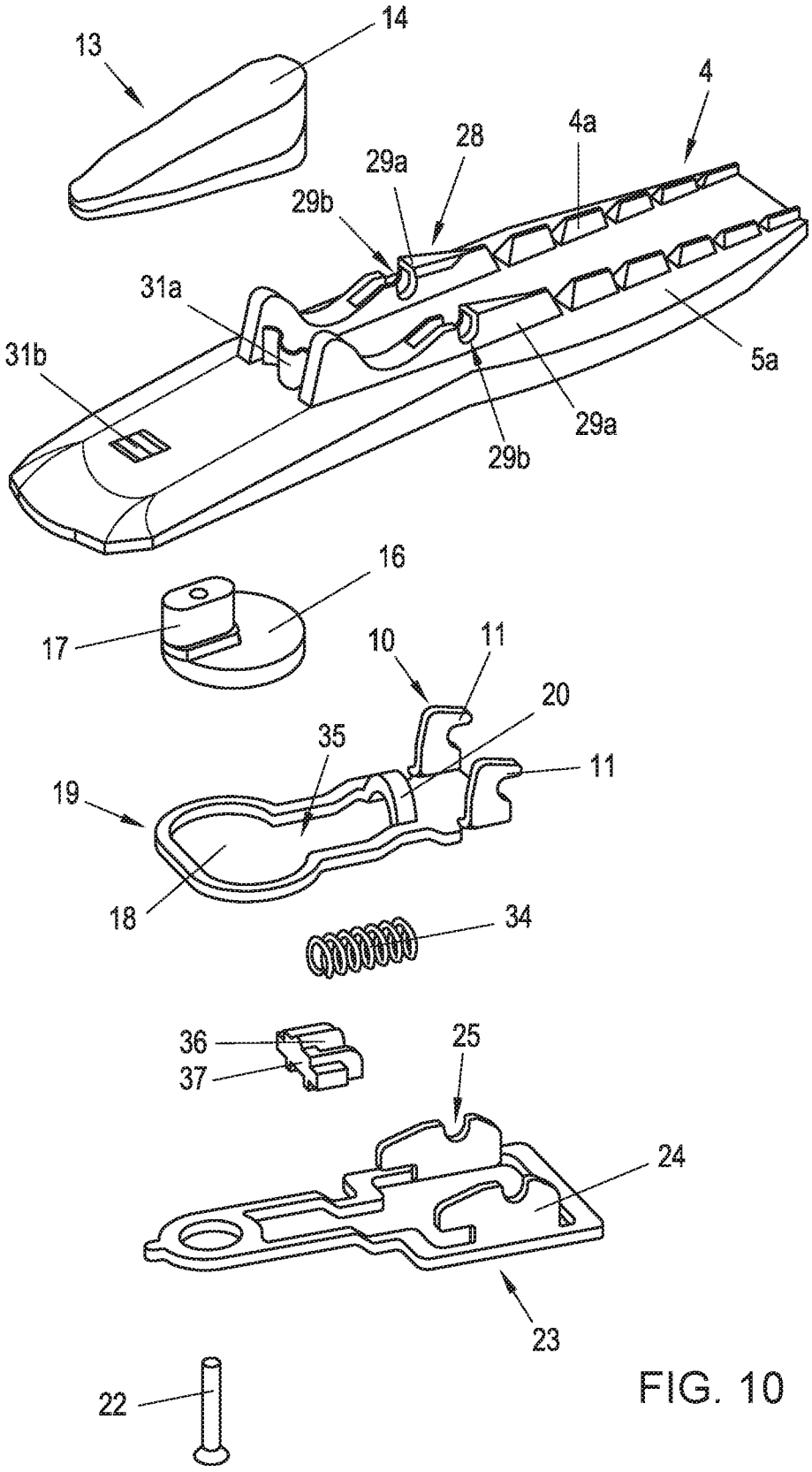
FIG. 10 schematically shows an exploded view of another cross-country binding according to the invention in which the holding element in the closed position is arranged on the binding base body to be displaceable counter to the effect of a spring.
Figure 11:
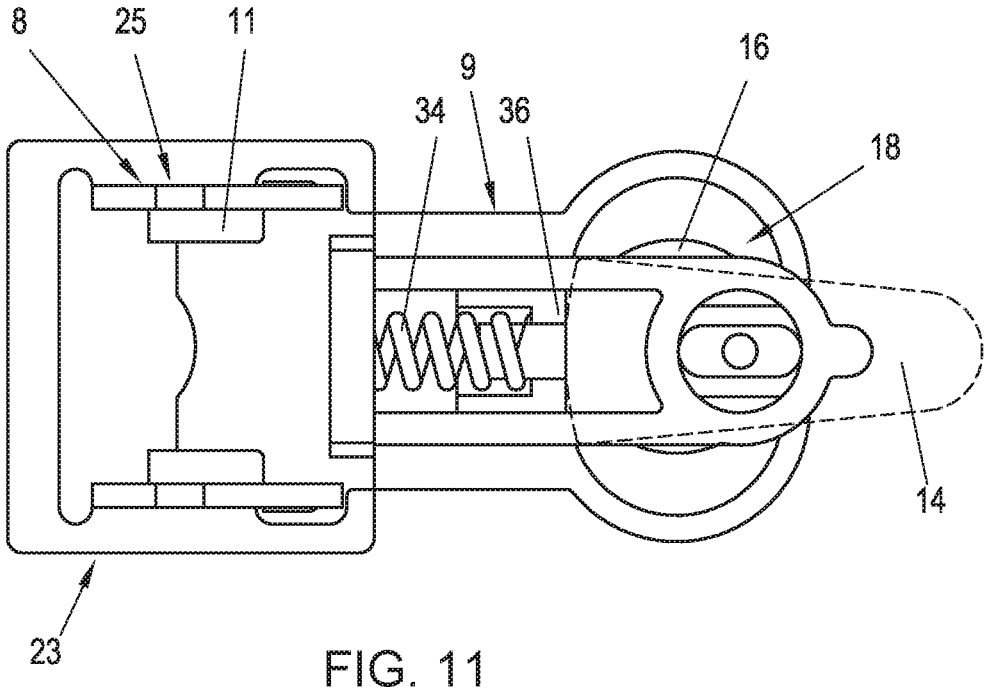
FIG. 11 shows a top view of the cross-country binding according to FIG. 10 (without the binding base body) in the non-rotated position of the rotating handle.
Figure 12:
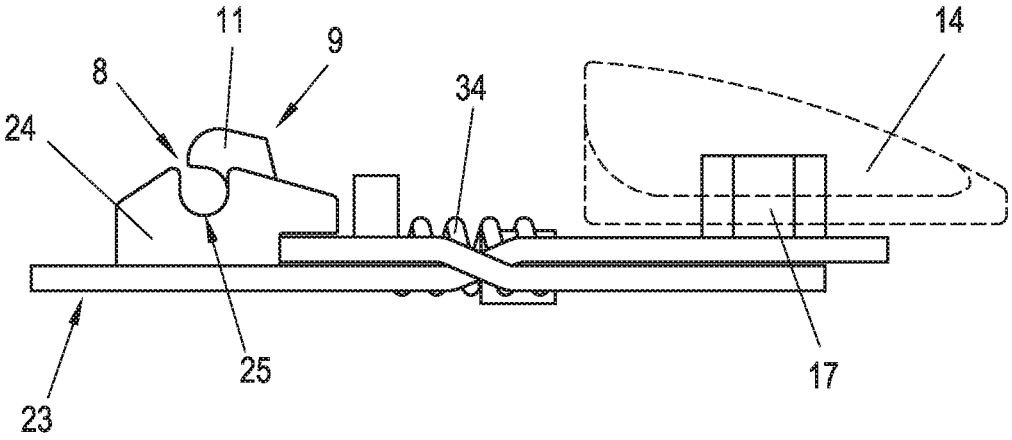
FIG. 12 shows a side view of the cross-country binding according to FIG. 11 in the non-rotated position of the rotating handle.
Figure 13:
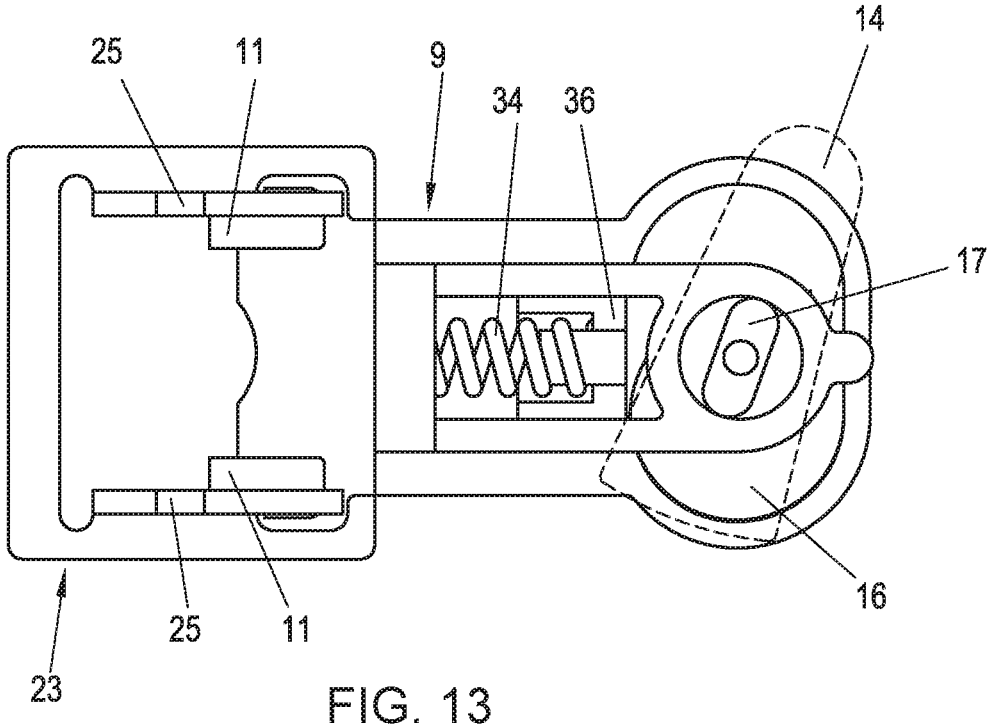
FIG. 13 shows a top view of the cross-country binding according to FIGS. 10 to 12 in the rotated position of the rotating handle.
Figure 14:
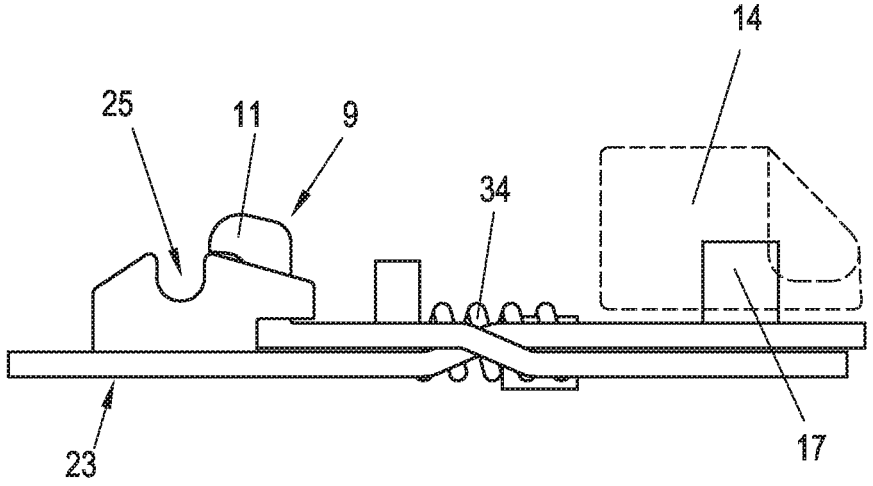
FIG. 14 shows a side view of the cross-country binding according to FIGS. 10 to 13 in the rotated position of the rotating handle.
Figure 15:
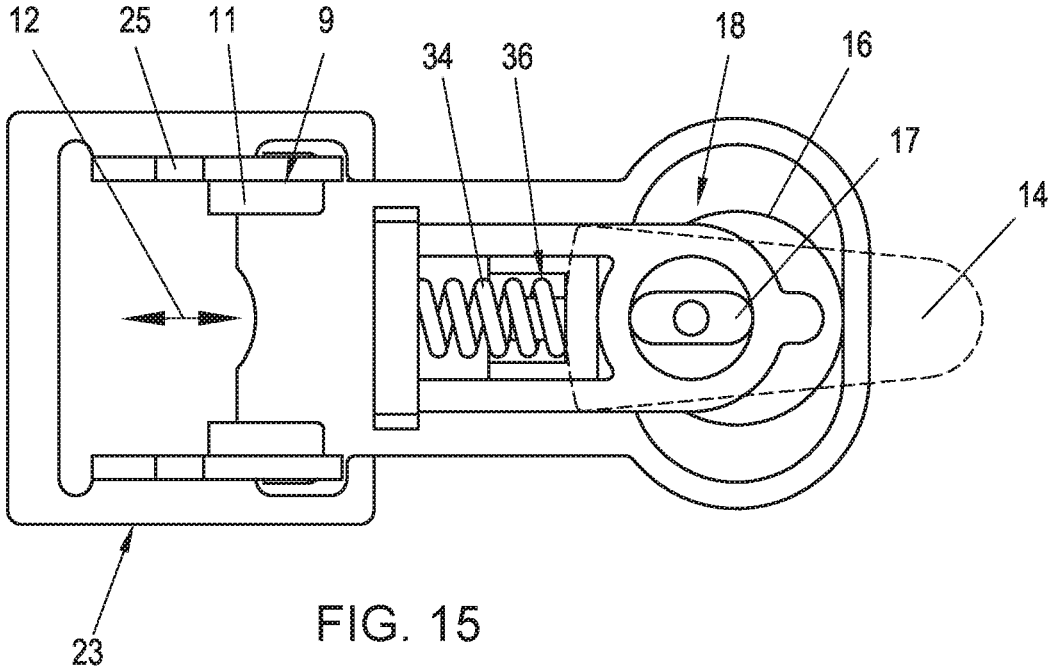
FIG. 15 shows a top view of the cross-country binding according to FIGS. 10 to 14 in the non-rotated position of the rotating handle, wherein the holding element has been displaced against the force of the spring into the open or release position freeing the hinge axis from the hook-shaped projections.
Figure 16:
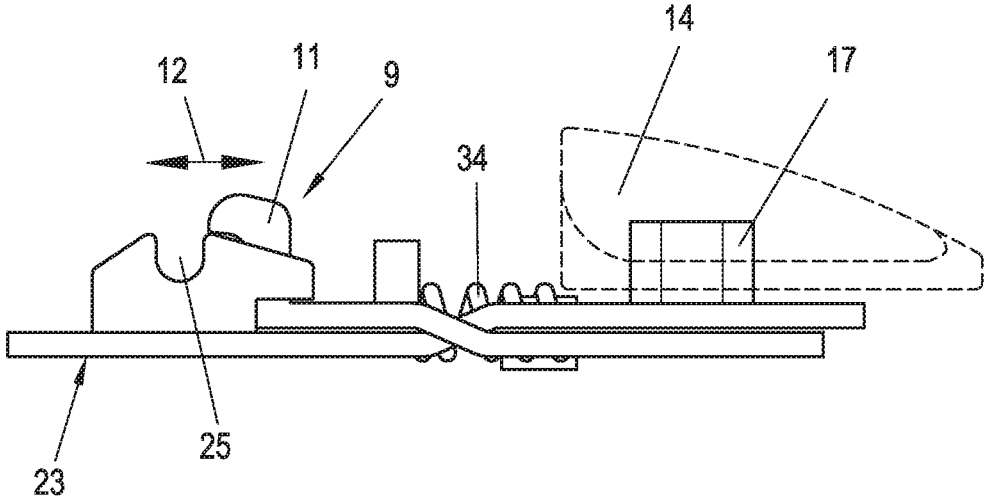
FIG. 16 shows the cross-country binding according to FIG. 15 in a side view.

According to the embodiment from FIGS. 8, 9, rotating handle 14 of actuating element 13 comprises a latching element 30*a*, which is engaged in the closed position with a latching element 31*a* formed on binding base body 4. In the embodiment shown, rotating handle 14 of actuating element 13 additionally comprises another latching element 30*b*, which is in latching engagement with another latching element 31*b* on binding base body 4 in the closed position. Latching element 30*b* is provided on a front end section of rotating handle 14 facing away from receptacle 8 in the closed position, and other latching element 30*a* is provided on a rear end section of rotating handle 14 facing receptacle 8. (First) connecting plane E1 extends essentially parallel to standing surface 5*a* of binding base body 4 between latching element 30*b* on rotating handle 14 and associated latching element 31*b* on binding base body 4. In contrast, (second) connecting plane E2 extends essentially perpendicular to standing surface 5*a* of binding base body 4 between latching element 30*a* on rotating handle 14 and associated latching element 31*a* on binding base body 4. A depression or latching groove 32*a* and a spring-mounted latching lug 33*a* are respectively provided on the side of receptacle 8 as corresponding to latching elements 30*a*, 31*a*. In the embodiment shown, latching groove 32*a* is provided on rotating handle 14 and latching lug 33*a* on binding base body 4. Correspondingly, a depression or latching groove 32*b* and a spring-mounted latching lug 32*b* are respectively provided on the side facing away from receptacle 8 as corresponding to latching elements 30*b*, 31*b*. In the embodiment shown, latching groove 32*b* is provided on rotating handle 14 and latching lug 33*b* on binding base body 4. In the embodiment shown, latching elements 31*a*, 31*b* are designed as wave-shaped to form spring-mounted latching lugs 33*a*, 33*b*. A release 33*c* is formed in each case on the longitudinal sides of latching lugs 33*a*, 33*b* with respect to the remaining binding base body 4.

An alternative embodiment of the force transmission mechanism between rotating handle 14 and holding element 9 with hooks 11 is shown in FIGS. 10 to 18. Subsequently, only the differences to the embodiment according to FIGS. 1 to 7 shall be addressed.

In the embodiment from FIGS. 10 to 18, holding element 9 is mounted on binding base body 4 to be displaceable in the closed position against the force of a spring 34, for example, a helical spring. For this purpose, recess 18 of holding element 9 comprises an open (i.e., not delimited by an abutment surface of holding element 9) section 35 on the side of receptacle 8. Spring 34 is arranged between holding element 9 and a spring abutment 36. A front end section 37 of spring abutment 36 borders open section 35 of recess 18 of holding element 9. In the closed position, spring abutment 36 contacts bulbous operating section 16*a* of eccentric disk 16 (see FIG. 11).

Figure 17:
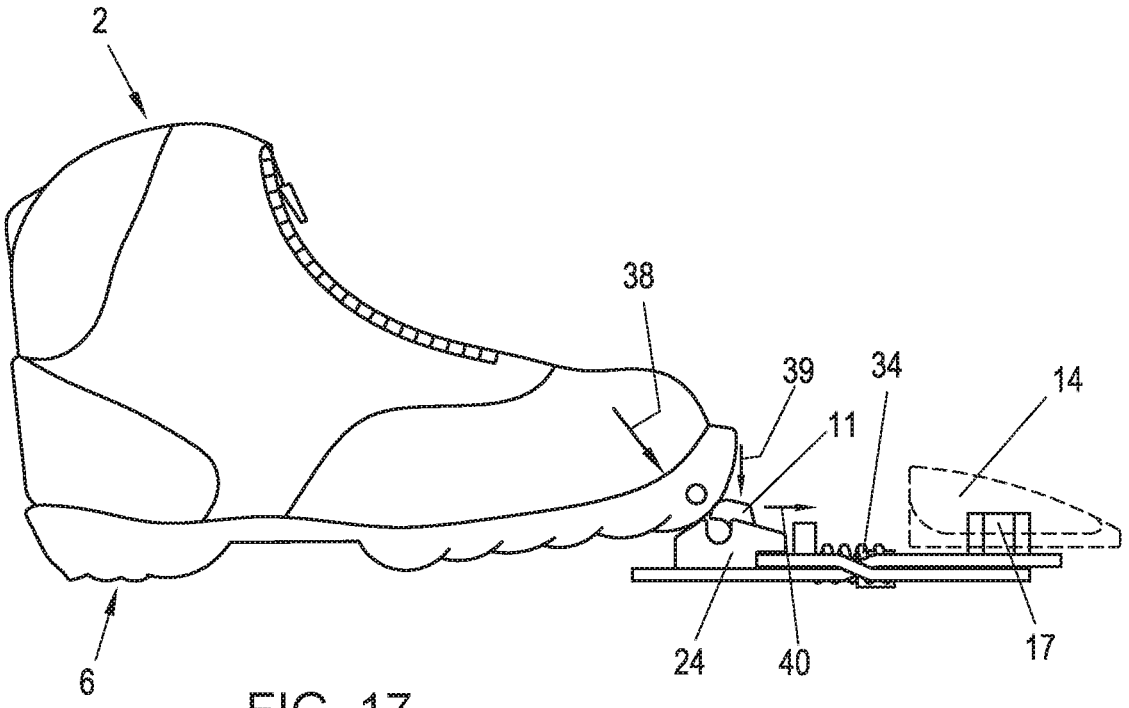
FIG. 17 shows the cross-country boot in the connection to the cross-country binding in the non-rotated position of the rotating handle.
Figure 18:
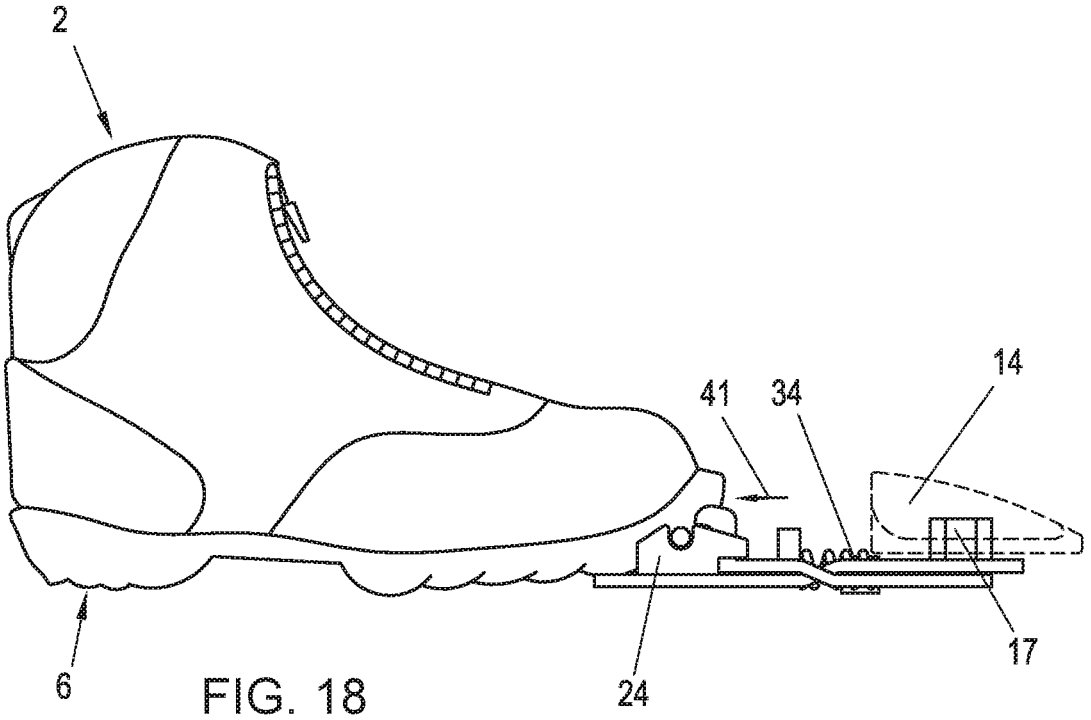
FIG. 18 shows the cross-country boot shortly before the spring-loaded snapping back of the hook-shaped projections into the engaged position with the hinge axis of the cross-country boot.

FIGS. 17, 18 show the arrangement of boot 2 on cross-country binding 1 in the non-rotated state of rotating handle 14. Due to a slanted placement of boot 2 in the direction of arrow 38, a force is applied in the vertical direction according to arrow 39 on a slanted surface of hook-shaped projections 11, so that holding element 9 is pressed forward against the effect of spring 34 (arrow 40). In this position, hinge axis 2*a* of boot 2 may snap into receptacle 8 of holding device 7. The stored spring energy of spring 34 presses holding element 9 back in direction of arrow 41 into the closed position. Advantageously, a stepping into binding 1 is thus possible without actuating the rotating handle.

The invention claimed is:

1. A cross-country or ski touring binding for connecting a boot to a ski in an articulated manner, comprising:

a binding base body comprising a standing surface for a sole of the boot and a ski contact surface for at least indirect contact on the ski, a holding device, comprising a receptacle for a pivotable arrangement of the boot about a pivot axis extending in the transverse direction of the binding base body, a holding element for holding the boot on the receptacle, wherein the holding element is mounted on the binding base body to be displaceable between a closed position holding the boot on the receptacle and an open position releasing the boot, and an actuating element which comprises a rotating handle for transferring the holding element from the closed position into the open position, wherein an axis of rotation of the rotating handle extends perpendicular to the standing surface of the binding base body, wherein the actuating element comprises a disk-shaped, eccentrically-mounted force transmission element, which is accommodated in a recess of the holding element such that, by a rotational movement of the rotating handle, the holding element is transferable from the closed position into the open position and vice versa.

2. The cross-country or ski touring binding according to claim 1, wherein the recess of the holding element is designed in a force transmission section of the holding element, wherein the force transmission section is connected via a connecting section to a holding section of the holding element, and wherein the holding section comprises hook-shaped projections.

3. The cross-country or ski touring binding according to claim 2, wherein the hook-shaped projections are displaceably accommodated in slot-shaped recesses in the binding base body.

4. The cross-country or ski touring binding according to claim 1, wherein the recess of the holding element accommodating the force transmission element is closed on the peripheral side.

5. The cross-country or ski touring binding according to claim 1, wherein the recess of the holding element accommodating the force transmission element comprises an open section on a side directed toward the receptacle.

6. The cross-country or ski touring binding according to claim 5, wherein the holding element is mounted to be displaceable against a force of a spring in the closed position.

7. The cross-country or ski touring binding according to claim 6, wherein the spring is arranged between the holding element and a spring abutment, wherein a front end section of the spring abutment is arranged at the open section of the recess of the holding element and is connected in the closed position to an operative section of the disk-shaped force transmission element.

8. The cross-country or ski touring binding according to claim 1, wherein the rotating handle of the actuating element comprises at least one latching element which, in the closed position, engages in a latching position with a latching element on the binding base body.

9. The cross-country or ski touring binding according to claim 8, wherein the rotating handle of the actuating element comprises at least two latching elements arranged at a distance from each other, wherein one of the at least two latching elements is provided in a front end section of the rotating handle facing away from the receptacle in the closed position and another latching element of the at least two latching elements is provided on a rear end section of the rotating handle facing the receptacle, and a plurality of additional latching elements corresponding to each of the at least two latching elements of the rotating handle are on the binding base body.

10. The cross-country or ski touring binding according to claim 9, wherein a first connection plane extends along the standing surface between the one of the at least two latching elements of the rotating handle and a corresponding one of the plurality of additional latching elements of the binding base body and/or a second connection plane extends perpendicular to the standing surface between the other latching element of the at least two latching elements of the rotating handle and a second corresponding latching element of the plurality of additional latching elements of the binding base body.

11. The cross-country or ski touring binding according to claim 8, wherein a latching groove and a spring-mounted latching lug are provided in each case as corresponding latching elements, wherein the latching groove is provided on the actuating element and the latching lug on the binding base body.

12. The cross-country or ski touring binding according to claim 11, wherein the latching lug is designed on a wave-shaped latching element, which comprises a release position on longitudinal sides with respect to a remaining binding base body or remaining actuating element.

13. The cross-country or ski touring binding according to claim 1, further comprising a bearing element which comprises bearing blocks each with a depression for pivotable arrangement of the boot, wherein the depressions of the bearing blocks are arranged adjacent to the receptacle of the holding device in the closed position.

14. The cross-country or ski touring binding according to claim 13, wherein the binding base body and the bearing blocks are designed as one piece, wherein the depressions of the bearing blocks are formed by material cut-outs of the binding base body.

15. The cross-country or ski touring ski kit comprising a cross-country or ski touring binding and comprising a cross-country or ski touring boot pivotably mounted thereon, wherein the cross-country or ski touring binding is designed according to claim 1.

* * * * *